US009414675B2

(12) United States Patent
Koelling et al.

(10) Patent No.: US 9,414,675 B2
(45) Date of Patent: Aug. 16, 2016

(54) DRAWER SLIDE

(71) Applicant: Lockdowel, Inc., Fremont, CA (US)

(72) Inventors: Fred Koelling, Foster City, CA (US); Venugopal Subramanyam, Fremont, CA (US)

( * ) Notice: Subject to any disclaimer, the term of this patent is extended or adjusted under 35 U.S.C. 154(b) by 0 days.

(21) Appl. No.: 14/824,825

(22) Filed: Aug. 12, 2015

(65) Prior Publication Data

US 2015/0342349 A1 Dec. 3, 2015

Related U.S. Application Data

(63) Continuation of application No. 14/564,019, filed on Dec. 8, 2014, now Pat. No. 9,131,772, which is a continuation of application No. 13/902,518, filed on May 24, 2013, now Pat. No. 8,931,861.

(60) Provisional application No. 61/652,094, filed on May 25, 2012.

(51) Int. Cl.

| | |
|---|---|
| ***A47B 88/00*** | (2006.01) |
| ***A47B 88/14*** | (2006.01) |
| ***A47B 88/04*** | (2006.01) |
| ***A47B 88/16*** | (2006.01) |

(52) U.S. Cl.

CPC ..... *A47B 88/14* (2013.01); *A47B 88/04* (2013.01); *A47B 88/0466* (2013.01); *A47B 88/16* (2013.01); *A47B 2210/0029* (2013.01)

(58) Field of Classification Search

CPC ..... A47B 2210/0018; A47B 2210/0059; A47B 88/0418; A47B 88/0422; A47B 88/044; A47B 88/0466; A47B 88/12; A47B 88/14; A47B 88/16; A47B 2100/0029

USPC ..... 312/334.7, 334.8, 334.9, 312/334.11–334.13, 334.19, 312/334.21–334.22, 334.41–334.43, 312/334.44–334.46, 228.1

See application file for complete search history.

(56) References Cited

U.S. PATENT DOCUMENTS

| | | | |
|---|---|---|---|
| 2,750,052 | A | 6/1956 | Brown et al. |
| 2,914,370 | A | 11/1959 | Hensch et al. |
| 3,472,573 | A | 10/1969 | Geiger |
| 3,743,366 | A | 7/1973 | Tazaki |
| 4,067,632 | A | 1/1978 | Sekerich |
| 4,097,098 | A | 6/1978 | Fields |
| 4,121,876 | A | 10/1978 | Ratti |
| 4,270,623 | A | 6/1981 | Brandl et al. |
| 4,362,346 | A | 12/1982 | Emmert |
| 4,427,245 | A | 1/1984 | Litchfield et al. |
| 4,437,715 | A | 3/1984 | Jenkins |
| 5,061,020 | A | 10/1991 | Ulrich |

(Continued)

FOREIGN PATENT DOCUMENTS

WO WO-2013/177553 A1 11/2013

*Primary Examiner* — Hanh V Tran

(74) *Attorney, Agent, or Firm* — Mintz Levin Cohn Ferris Glovsky and Popeo, P.C.

(57) ABSTRACT

The drawer slide assembly may include an elongate member including a first slot extending through an upper region and a second slot. The drawer slide assembly may further include a first end cap coupled to the first end region of the elongate member, wherein the first end cap has a first projection that extends at least in part through the first opening; and a second end cap coupled to the second end region of the elongate member, wherein the second end cap has a second projection that extends at least in part through the second opening.

19 Claims, 10 Drawing Sheets

FIG. 1A

(56) References Cited

U.S. PATENT DOCUMENTS

| | | | |
|---|---|---|---|
| 5,242,222 | A | 9/1993 | Michael |
| 5,302,030 | A | 4/1994 | Buie et al. |
| 5,484,197 | A | 1/1996 | Hansen et al. |
| 5,733,026 | A | 3/1998 | Munachen |
| 5,961,193 | A | 10/1999 | Hobbs |
| 6,460,954 | B1 | 10/2002 | Bayani et al. |
| 6,854,816 | B2 | 2/2005 | Milligan |
| 6,938,617 | B2 | 9/2005 | Le et al. |
| 7,001,004 | B2 | 2/2006 | Bartloff et al. |
| 1,109,812 | A1 | 9/2014 | Yawman |
| 8,931,861 | B2 | 1/2015 | Koelling et al. |
| 9,131,772 | B2 | 9/2015 | Koelling et al. |
| 2001/0003407 | A1 | 6/2001 | Fraccaro |
| 2002/0033657 | A1 | 3/2002 | Kim et al. |
| 2004/0051428 | A1 | 3/2004 | Bartloff et al. |
| 2008/0157643 | A1 | 7/2008 | Chen |
| 2009/0185853 | A1 | 7/2009 | Koelling et al. |
| 2009/0199375 | A1 | 8/2009 | Koelling et al. |
| 2012/0210545 | A1 | 8/2012 | Koelling et al. |

DRAWER SLIDE

CROSS REFERENCE TO RELATED APPLICATIONS

This application is a continuation of co-pending U.S. patent application Ser. No. 14/564,019, filed Dec. 8, 2014, titled "Drawer Slide," which is a continuation of Ser. No. 13/902,518, filed May 24, 2013, titled "Drawer Slide," now U.S. Pat. No. 8,931,861, which in turn claims priority under 35 U.S.C §119(e) to U.S. Provisional Patent Application Ser. No. 61/652,094, filed May 25, 2012, titled, "Drawer Slide." Priority of the filing date of the Provisional patent application is hereby claimed. The disclosures of the aforementioned patent applications are incorporated by reference herein each in their entirety.

BACKGROUND

Many conventional drawer slides include at least two rails on each side of a drawer that slide relative to each other to allow translation of the drawer. Drawer slides are often cumbersome to install in furniture, whether installed by professionals or by a consumer assembling furniture at home. This complexity is due to the specificity of the configuration of the drawer slide to the location of the slide. Drawer slide installation may also be complicated by the number of fittings that need to be secured to affix the drawer slide to the drawer and the piece of furniture into which the drawer fits.

SUMMARY

In some example embodiments, there is provided a drawer slide assembly. The drawer slide assembly may an elongate member including a first slot extending through an upper region of a first face of the elongate member between a first end region of the elongate member and an opposite, second end region of the elongate member, wherein the first end region of the elongate member has at least a first opening into the first slot and a second slot extending through a lower region of a second face of the elongate member between the first end region and the second end region of the elongate member, wherein the second face is opposite the first face, wherein the second end region of the elongate member has at least a second opening into the second slot. The drawer slide assembly may further include a first end cap coupled to the first end region of the elongate member, wherein the first end cap has a first projection that extends at least in part through the first opening; and a second end cap coupled to the second end region of the elongate member, wherein the second end cap has a second projection that extends at least in part through the second opening.

In some variations, one or more of the features disclosed herein including one or more of the following features can optionally be included in any feasible combination. The at least one of the first and second projections is an attachment mechanism configured to attach at least one of the first and second end caps to the elongate member. The first opening extends through an upper surface of the upper region of the elongate member and the second opening extends through a lower surface of the lower region of the elongate member. The first projection is a first reinforcement pin that extends through the first slot and at least a portion of the second slot and wherein the second projection is a second reinforcement pin extends through the second slot and at least a portion of the first slot. The at least one of the first and second reinforcement pins is U-shaped. The at least one of the first and second projections is formed at least in part of hardened metal. The first end cap further comprises a first articulating element and the second end cap further comprises a second articulating element. The first and second articulating elements are each configured to articulate in a direction orthogonal to a longitudinal axis of the elongate member between a closed positioned and an open position. The first and second articulating elements are each biased into the closed configuration. The closed position of the first articulating element comprises the first articulating element articulated toward a longitudinal axis of the first slot, and wherein the open position of the first articulating element comprises the first articulating element articulated away from the longitudinal axis of the first slot. The closed position of the second articulating element comprises the second articulating element articulated toward a longitudinal axis of the second slot, and wherein the open position of the second articulating element comprises the second articulating element articulated away from the longitudinal axis of the second slot. The drawer slide assembly may further comprise at least a first roller and a second roller. The first roller is configured to insert and move through the first slot and wherein the second roller is configured to insert and move through the second slot. The first articulation element in the closed position prevents the first roller moving through the first slot from exiting the first slot and wherein the second articulation element in the closed position prevents the second roller moving through the second slot from exiting the second slot. Each of the articulating elements further comprises a flat surface facing the slot and an inclined surface facing away from the slot. The application of pressure by the rollers on the inclined surfaces causes articulation of the articulating elements into an open position and allows entry of the rollers into the slots. Each of the articulating elements further comprises a manual release latch that is configured to articulate the articulating elements into the open position. The first and second projections articulate with the articulating elements. The first roller has a first latch configured to couple the first roller to a cabinet or drawer and wherein the second roller has a second latch configured to couple the second roller to a cabinet or drawer. The drawer slide assembly is affixed to the cabinet or drawer only by the first and second rollers inserted and moving through the first and second slots. The elongate member is an extruded member formed of metal. The at least one of the first and second slots is u-shaped, c-shaped, or d-shaped. The drawer slide assembly is symmetrical and possesses no handedness.

DRAWING DESCRIPTIONS

Like reference symbols in the various drawings may indicate like elements.

DETAILED DESCRIPTION

The subject matter disclosed herein provides apparatus and methods related to drawer slides, including the fabrication, use, and installation of drawer slides.

Figure 1A:
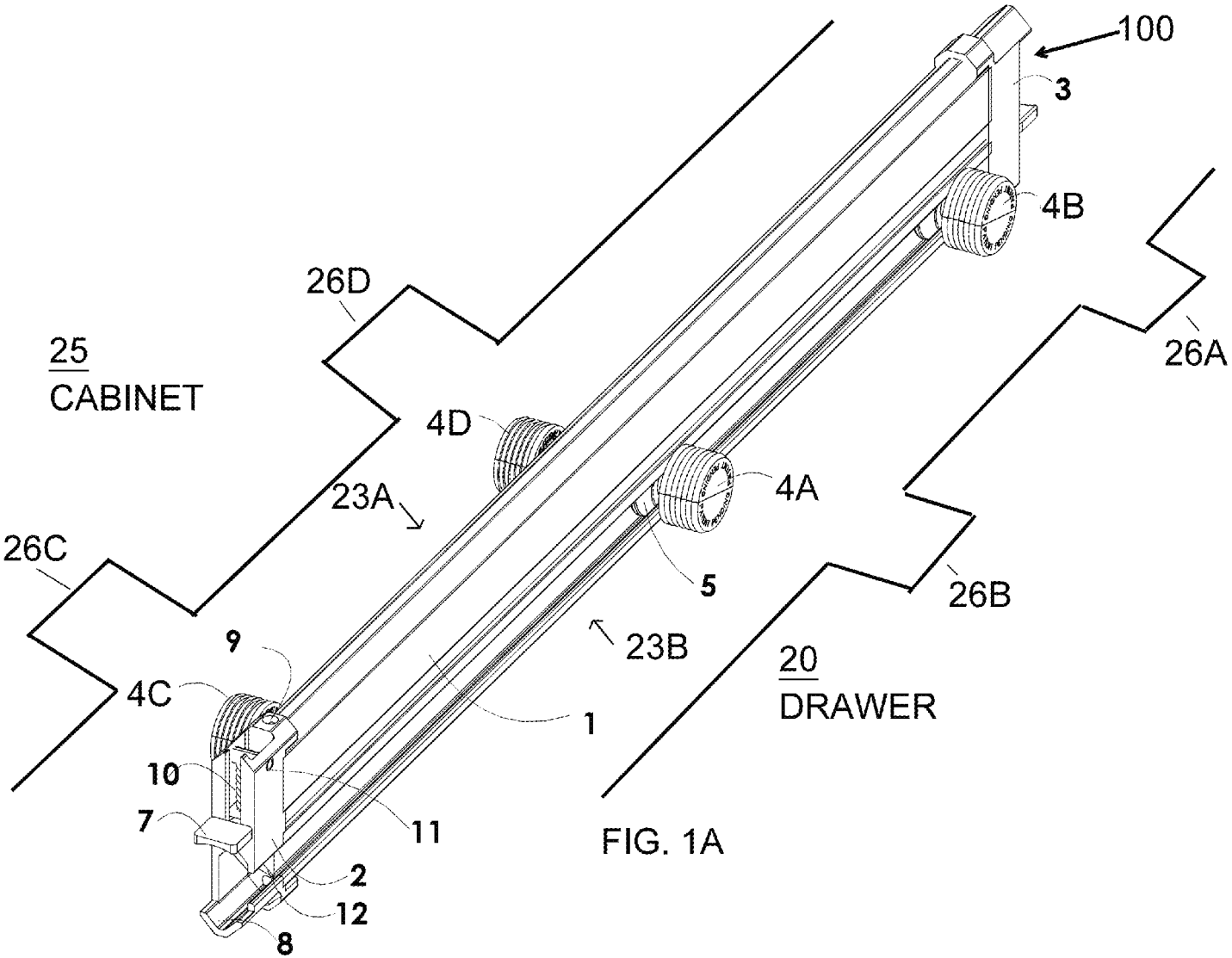
FIG. 1A shows an implementation of a drawer slide.

FIG. 1A shows a side view of an implementation of a drawer slide 100. The drawer slide 100 may include a member, such as an extruded member 1, with end cap members 2, 3 on distal ends of the extruded member. The extruded member 1 may also include slots disposed on each face 23A-B (or side); each of the slots forms a channel running along the longitudinal axis of the extruded member 1. FIG. 1A depicts a side view 23B of the drawer slide, so only one slot is depicted.

The slots on each face of the extruded member are configured to receive rollers (FIG. 1A only depicts the side view of roller 5) fixedly captivated within the slots formed by the extruded member 1. The slot on a first face 23A can be located on an upper region on the face 23A, above the slot on a second face 23B. The slot on the second face 23B can be located on a lower region of the face. Rotation of the extruded member 1 shown in FIG. 1A 180° about the midpoint along the length of the extruded member results in the slot on the first face 23A being located above the slot on the second face 23B. However, rotation of the extruded member 180° about the midpoint along the height of the member yields the same location of the rails on each side. The extruded member may not have specificity with respect to the drawer, e.g. the extruded member 1 is not required to be used exclusively on one side of the drawer (e.g. left or right) because of the configuration of the slots on the first and second faces. The extruded member may be fabricated from any substantially rigid material, such as a metal, a metal alloy, aluminum, a polymer, a composite material, a ceramic material, a plastic, or a combination thereof.

The rollers 5 may have a substantially spherical shape to allow the rollers to roll, slide, or otherwise travel within the slots. Alternatively, or additionally, the rollers may have a substantially disk shape or any other suitable shape to allow the rollers to roll, slide, or otherwise travel within the slots.

The rollers 5 are attached via latches 4A-D (e.g., pins, dowels, or other attaching mechanism) to a drawer or a cabinet/skeleton into which the drawer fits. In some implementations, each roller 5 is fixedly attached to a drawer 20 and a cabinet (or cabinet skeleton) 25 by latch housings 4A-D. For example, latch housing 4A-B may be inserted (e.g., fixedly, releasably, etc.) into cavities (or holes) 26A-B in a drawer 20, while latch housing 4C-D may be inserted (e.g., fixedly, releasably, etc.) into cavities (or holes) 26C-D in cabinet/skeleton 25 for the drawer 20.

The extruded member 1 may include end caps 2, 3 on the distal ends. Generally, the end caps serve to allow the rollers, or wheels, to enter and exit the slots, and serve to captivate the rollers so that they do not roll past the end of the extruded member. The end caps 2, 3 may also include an articulating element, such as a trap-door, 12 to allow the rollers to enter and exit the slots when the trap door is opened. For example, if the drawer is to be removed from, or inserted into, the cabinet, the rollers may be inserted into the slots by opening the trap door (e.g., by depressing manual release latch 7). The end caps 2, 3 may include an entry ramp 8 adjacent to the trap door 12.

The trap door 12 may be held in a closed position that retains rollers 5 in the slots by a biasing element 10, such as a spring, a hydraulic piston, or the like. The biasing element 10 may be attached to a manual release latch 7, and a pin 11 may keep the biasing element 10 in place to apply pressure or tension to keep the trap door 12. The articulating element, or trap door, 12 may move substantially perpendicular, or orthogonal, to the long axis of the extruded member 1, and thus, of the long axis of each of the slots.

A metal pin inserted through a connecting port 9 may also be used to fixedly couple the end cap 2 to the extruded member 1, although other attachment mechanisms may be used to fixedly attach the end cap 2. The connecting port 9 shown in FIG. 1A is seen at the top of the end cap 2, and thus may mate with a hole in the member 1 through its top. It should be noted that end cap 2 and end cap 3 may be substantially similar, and that end cap 3 may be oriented in a mirror image, with the middle of the member 1 taken as the mirror point, with respect to end cap 2. A connecting port 9 may also be present on end cap 3, but in FIG. 1A, such a port would mate with a hole in the member 1 through its bottom. In any orientation, the connecting port 9 may be located on a projection which extends away from the manual release latch 7, such as towards the extruded member.

As the rollers 5 which are attached to a drawer and a cabinet/skeleton are situated in the slots in the extruded member 1, the extruded member 1 and the end caps 2, 3 may not be attached by any other means to either the drawer or the cabinet/skeleton. Because of the ability of the extruded member 1 and end caps 2, 3 to be separated from the rollers 5 by opening the trap door (e.g. operating the manual release latch 7), the extruded member 1 and end caps 2, 3 may not be permanently attached to either the drawer or the cabinet/skeleton.

Figure 1B:
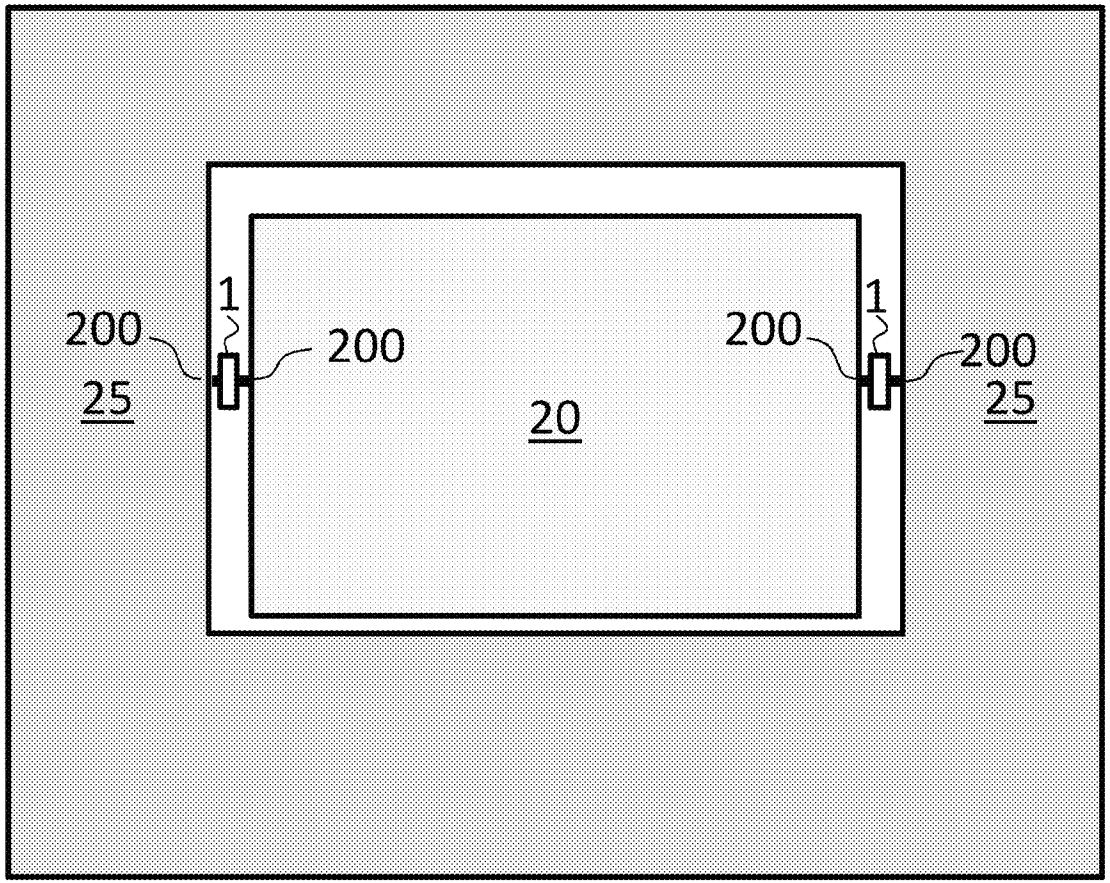
FIG. 1B shows an implementation with two drawer slides used with a drawer and a cabinet skeleton.

FIG. 1B shows a cross-sectional view of two drawer slides, such as drawer slide 100 and the like, used with a drawer 20 and a cabinet skeleton 25. The drawer 20 has a right and a left side. On each side of the drawer 20, drawer slide 100, may be located in the space between the drawer 20 and the cabinet skeleton 25. In each side of the drawer 20, two rollers assemblies 200 (described further below) may be positioned to couple the drawer 20 to the extruded member 1 of the drawer slide 100 (e.g., latch housings couple to the drawer and the rollers couple to the member). As such, four total roller assemblies 200 couple the member 1 to the drawer 20, although other quantities of roller assemblies may be used as well. In each side of the cabinet skeleton 25, two rollers assemblies 200 (described further below) may be positioned to couple the cabinet skeleton 25 to the member 1 (e.g., latch housings couple to the cabinet skeleton 25 and the rollers couple to the member). In contrast to conventional drawer slides, the drawer slide shown in FIGS. 1A and 1B may be utilized without regard to the side of the drawer upon which they are used, i.e., a drawer slide 100 may be used on either side of the drawer. This non-specificity with respect to drawer slide location during use may be due in part to the configuration of the extruded member 1 and the end caps 2, 3, more particularly the slots within the extruded member 1.

Figure 1C:
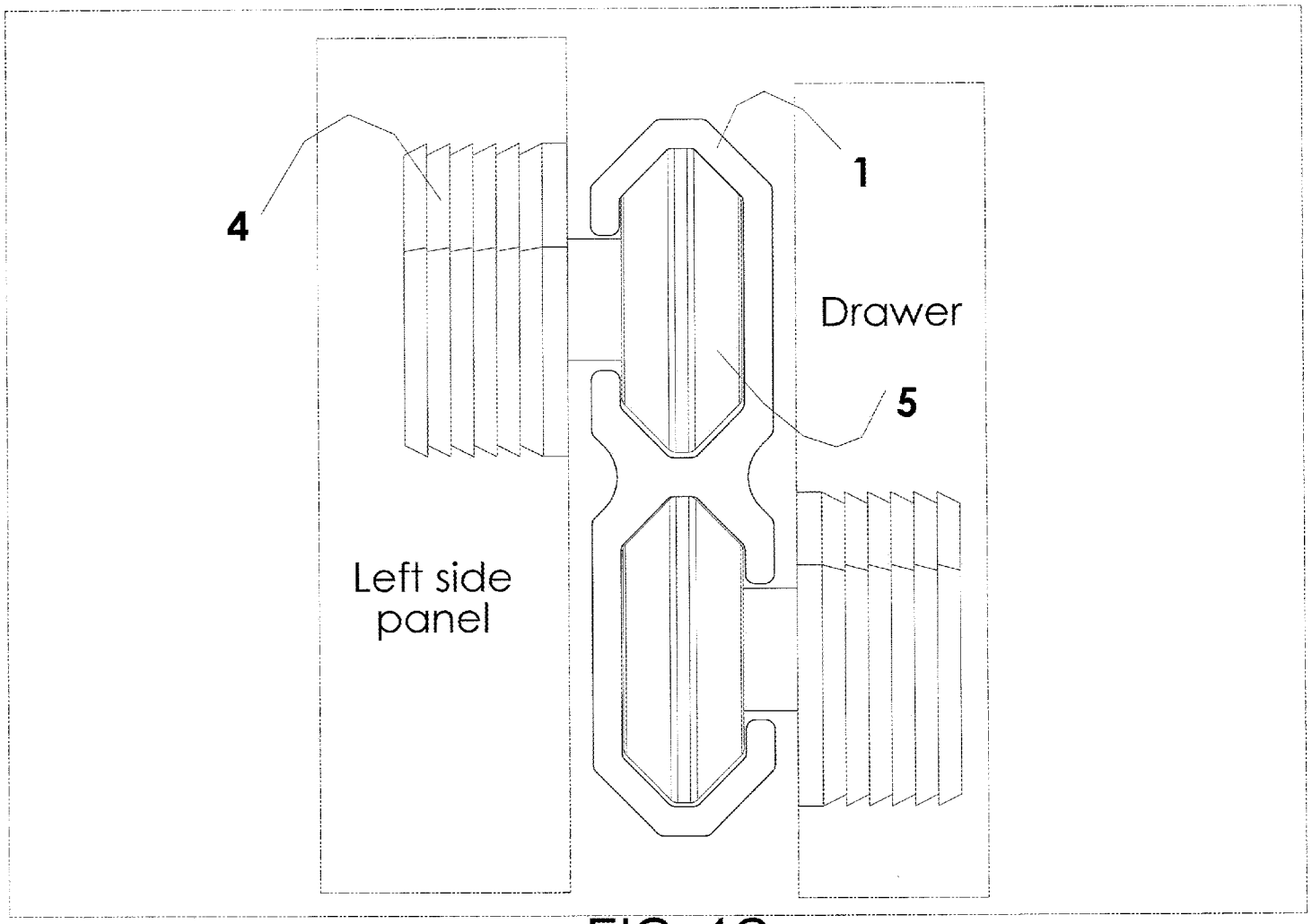
FIG. 1C shows a cross-sectional view of an implementation of rollers in a slide when used with a drawer in a cabinet, as in FIG. 1B.

FIG. 1C shows a cross-sectional view of an implementation of rollers 5 in a slide 1 when used with a drawer 20 in a cabinet 25, as in FIG. 1B. The relative situation of the rollers 5 that are connected to the cabinet 25 and drawer 20 via latches 4 within a single slide 1 can be seen in FIG. 1C.

Figure 1D:
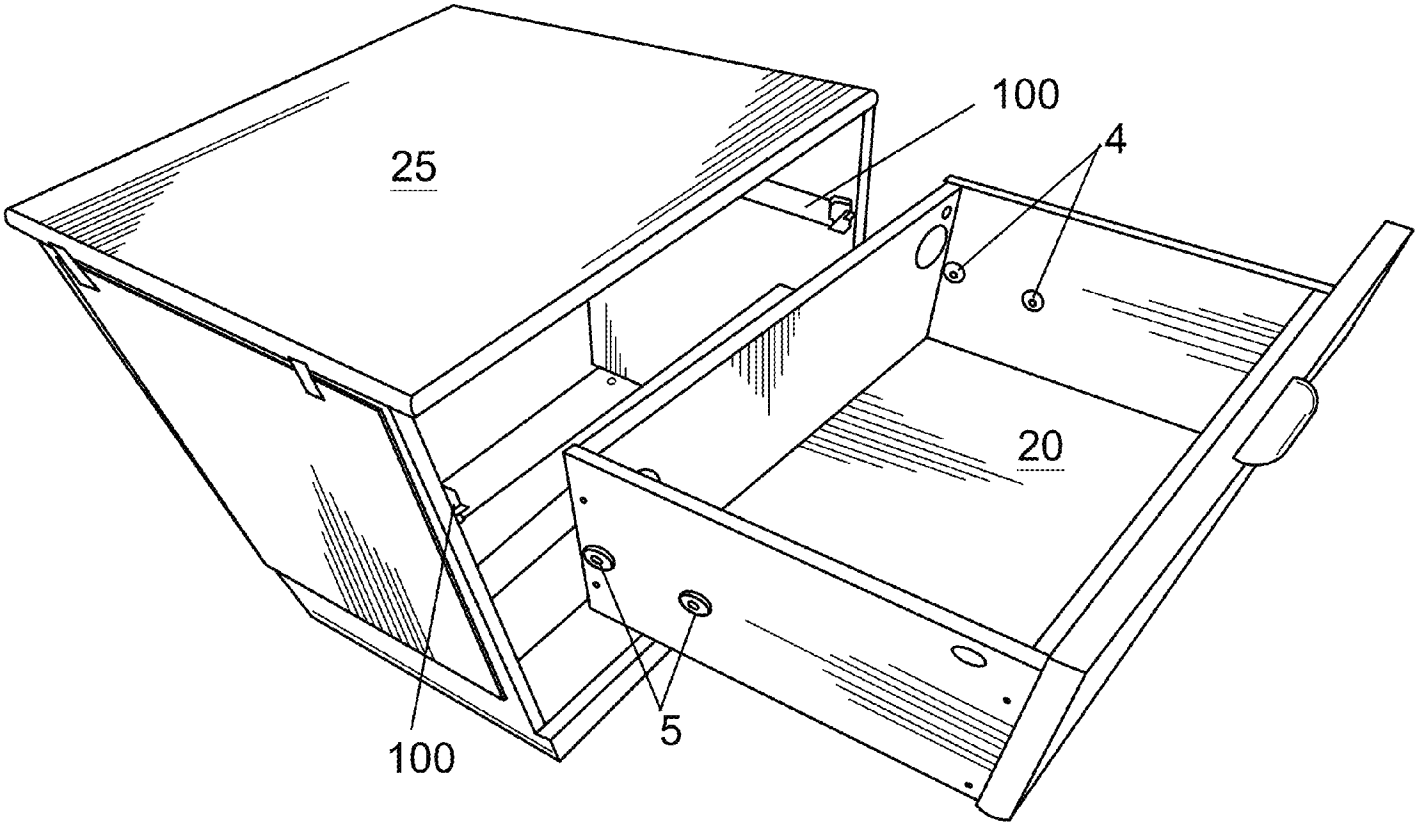
FIG. 1D shows an example of insertion of a drawer into a cabinet in an implementation of two drawer slides used with a drawer and a cabinet.

FIG. 1D shows an example of insertion of a drawer into a cabinet in an implementation of two drawer slides, such as drawer slide 100, used with a drawer 20 and a cabinet 25. The rollers 5 can be seen protruding from the sides of the drawer 20. There are two rollers 5 on each side of the drawer in this implementation. The members 1 that receive the rollers 5 on each side of the drawer are inside of the cabinet. A user or person assembling the cabinet aligns the rollers with the slots on the end caps attached to the exposed ends of the drawer slide extruded members and exerts force on the drawer until the rollers move beyond the end caps and on to the slots, as described above.

Figure 2A:
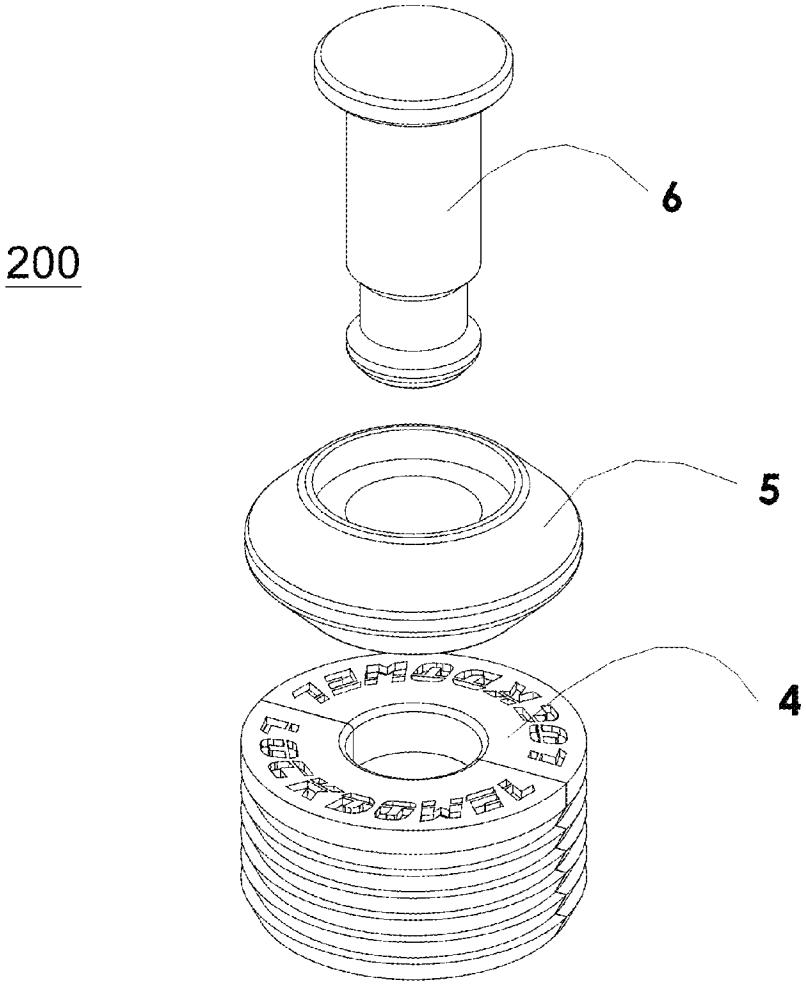
FIG. 2A shows an exploded view of a first implementation of a roller assembly.

FIG. 2A shows an exploded view of an implementation of a roller assembly 200 including roller 5, latch housing 4, and track pin 6. The latch housing 4 may be installed in a drawer, a cabinet skeleton, and the like. For example, a receptacle, such as a cavity or a hole, may be drilled into the drawer or the cabinet skeleton to receive the latch housing 4, so that the latch housing 4 is fixedly coupled to the drawer or the cabinet skeleton. The latch housing 4 may be inserted into the hole by any suitable method, such as by screwing, hammering, pushing, or the like. The latch housing 4 may include an opening in its center for receiving one end of the track pin 6.

Figure 2B:
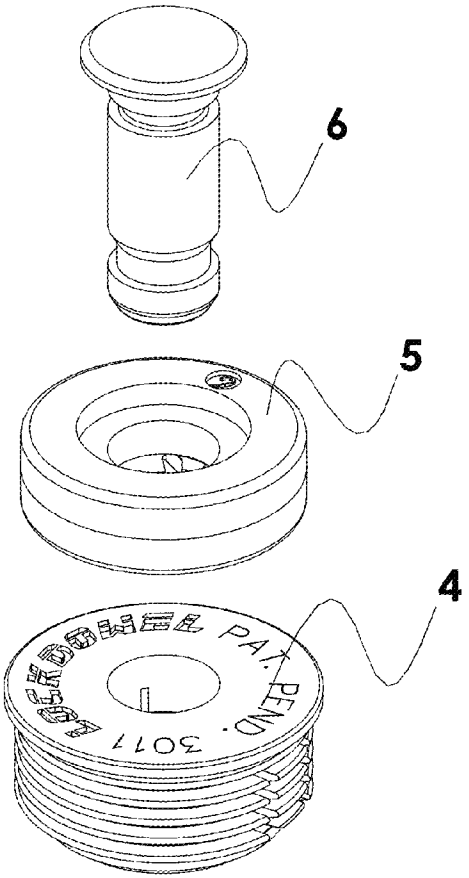
FIG. 2B shows an exploded view of a second implementation of a roller assembly.

FIG. 2B shows an exploded view of a second implementation of a roller assembly 200. The roller assembly 200 includes the roller 5, the latch housing 4, and the track pin 6. The roller assembly shown in FIG. 2B differs from that shown in FIG. 2A in that the roller 5, the latch housing 4, and the track pin 6 have different dimensions. Even though the roller 5, the latch housing 4, and the track pin 6 may be of different dimensions, each part of the roller assembly 200 functions in a manner as previously described.

Figure 2C:
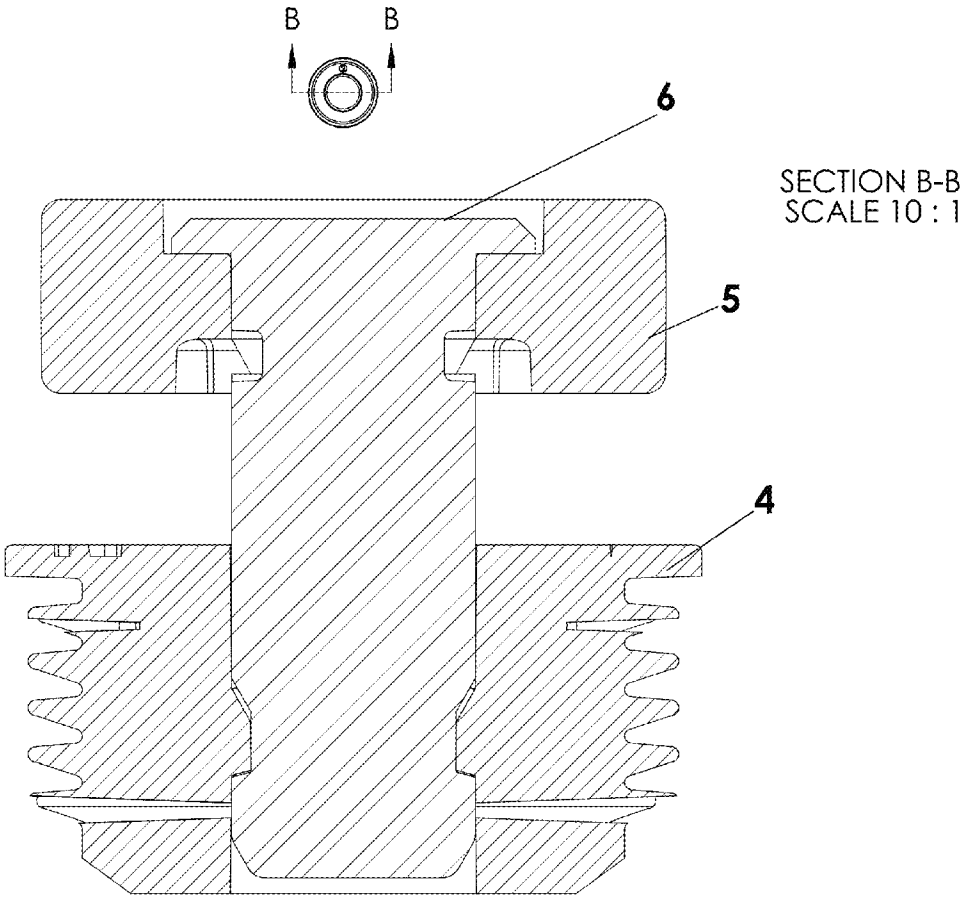
FIG. 2C shows a cross-sectional view of the roller assembly shown in FIG. 2B.

FIG. 2C shows a cross-sectional view of the roller assembly 200 shown in FIG. 2B. The view of the roller assembly 200 shows the roller 5 and the latch housing 4 attached to the track pin 6. The roller 5 is shown separated from the latch housing 4 by a distance that corresponds to at least the thickness of the extruded member so that the roller 5 can move freely within the slot of the extruded member.

Although a variety of mechanisms may be used to provide the roller assembly, in some exemplary implementations, the latch housing 4 and pin 6 are implemented as a lock dowel, such as those described in U.S. patent application Ser. No. 12/168,809, Publication No. US 2009-0185853, entitled "Releasable Locking Mechanism," filed Jul. 7, 2008; U.S. patent application Ser. No. 12/358,667, Publication No. US 2009-0199375, entitled "Latching System," filed Jan. 23, 2009; and U.S. patent application Ser. No. 13/503,007, Publication No. US 2012-0210545, entitled "Latching System," filed Apr. 19, 2012, all three of which are incorporated herein by reference herein in their entirety.

Referring to FIG. 2C, the track pin 6 couples the roller, or wheel, 5 to the latch housing 4, when the track pin is inserted through the roller 5 and the latch housing, as shown in FIGS. 2A-C. The components of the roller assembly 200 may all be made of the same material or they may be made of different materials. For example, the roller 5 may be made of a slippery, but durable material, such as a polymer (e.g. nylon), while the track pin 6 and latch housing 4 may be made of metal, although other materials may be used as well. The track pin 6 may be made of metal coated with polymer, or two or more metals, such as zinc plated steel. Each roller 5 may include ball bearings. The ball bearings may be any suitably durable material, such as a high-wear polymer, metal (e.g. steel), ceramic, composite, or any combination thereof. In some implementations, the roller assembly 200 may be assembled without the use of tools. That is to say that the track pin 6 may be inserted through the roller 5 and into the latch housing 4 by a user using only his or her hands, although a tool may be used in some instances as well.

Figure 3A:
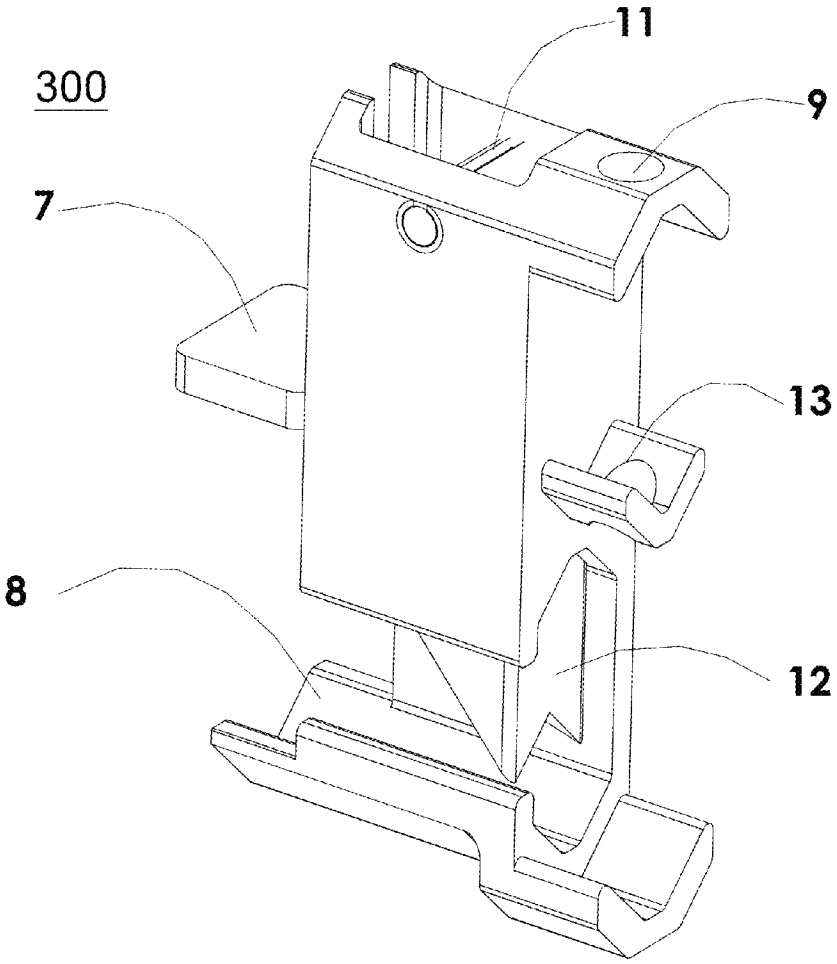
FIG. 3A shows an enlarged view of a first exemplary end cap member with trap door component.

FIG. 3A shows an enlarged view of an exemplary end cap member 300 with a trap door 12, which can be used with a drawer slide, such as drawer slide 100, to provide a stop or end to a first slot on one side of a extruded member of the drawer slide while providing a trap-door entrance to a second slot on the reverse side of the extruded member. Attachment mechanisms, such as pins through connecting ports 9 and 13, may be used to attach the end cap member to an end of an extruded member 1 (as shown in FIG. 1). The trap door 12 may be oriented with a slot in the extruded member 1. The biasing element 10 (shown in FIG. 1) may hold the trap door 12 in a lowered position by default, so that the roller 5 does not roll out of the slot unless the trap door 12 is opened by, for example, depressing manual release latch 7. The roll pin 11 may hold the biasing element 10 in place. The tension or pressure provided by the biasing element 10 to hold the trap door 12 closed as shown in FIGS. 1A and 3A may be overcome either by a roller 5 (shown in FIG. 1A) exerting force on the inclined surface of the trap door 12 or by a user exerting force on the manual release latch 7. The surface opposed to the inclined surface of the trap door 12 may be flat and may retain rollers 5 in the slots. The entry ramp 8 of the end cap member may be shaped to accommodate the shape of a specific type of roller 5 and facilitate the sliding of a roller 5 into a slot. Similarly, the slots of the extruded member may be curved or angled to optimize the fit between a roller and a slot. For example, when inserting roller 5 into the slot, the wheel initially enters via entry ramp 8, which is shaped to open the trap door 12. However, once roller 5 traverses the trap door 12, the trap door shuts captivating the wheel 5 in the slot, unless the manually release latch 7 is depressed to again open the trap door 12.

Figure 3B:
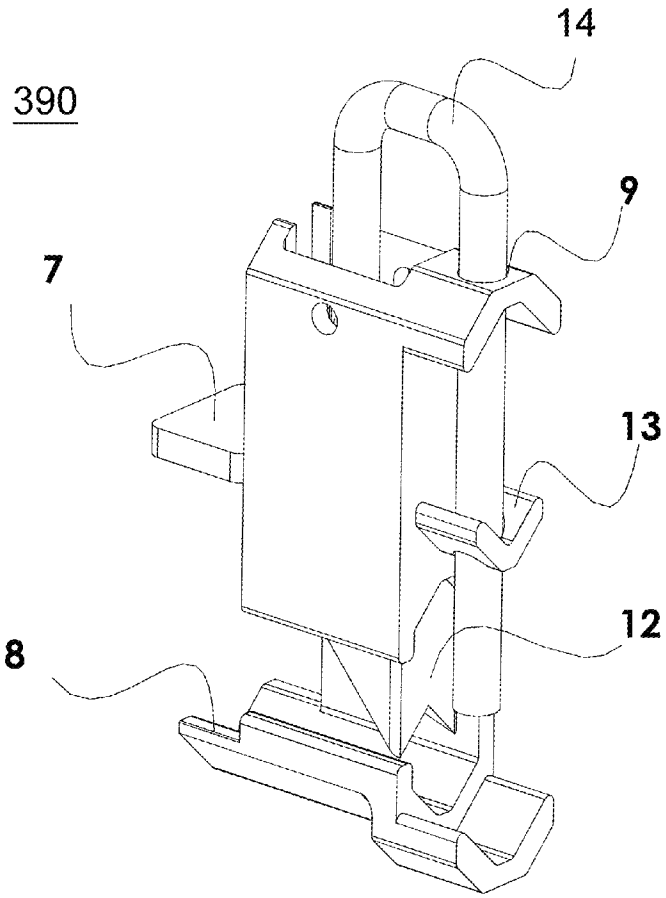
FIG. 3B shows an enlarged view of a second exemplary end cap member with trap door component.

FIG. 3B shows an enlarged view of a second exemplary end cap member 390 with trap door component with similar components to the end caps shown in FIG. 3A. End cap member 390 can also be used with a drawer slide, such as drawer slide 100, to provide a stop or end to a first slot on one side of the extruded member of the drawer slide while providing a trap-door entrance to a second slot on the reverse side of the extruded member. FIG. 3B shows a reinforcing "U" pin 14 that is not shown in FIG. 3A. The reinforcing pin 14 may be made of metal, such as a hardened metal. As the articulating element, or trap door, 12 moves up and down, the reinforcing pin 14 articulates upwards and downwards as well. The end caps may be structurally stronger with a reinforcing pin 14 than without, particularly when a heavier load is contained in the associated drawer or when the drawer is tipped to a steep angle, for example about 45 degrees.

Figure 3C:
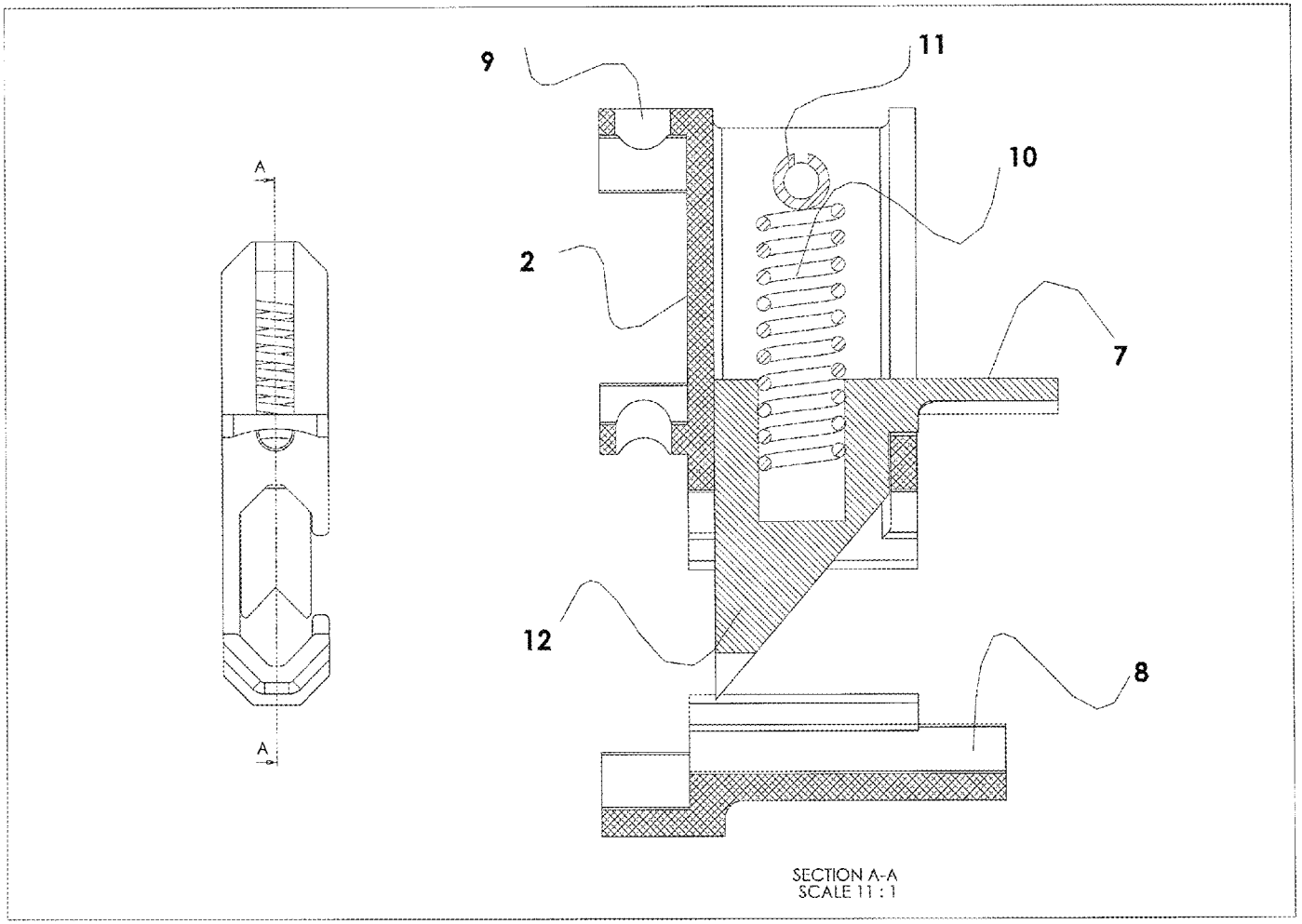
FIG. 3C shows cross-sectional view of the exemplary end cap member shown in FIG. 3A.

FIG. 3C shows cross-sectional view of the exemplary end cap member shown in FIG. 3A. In this view, the biasing element 10 is shown as a spring that fits partially within the release latch 7 and is held in place by the roll pin 11. The size and position of the slot within the end cap is shown with the trap door 12 in the lowered position as well as without the trap door 12 in view.

As mentioned above, an end cap, or end cap member, may be attached to an extruded member 1 with metal pins inserted into connecting ports 9 and 13. In the end cap member 390 with a reinforcing pin 14, the reinforcing pin 14 may extend upwards from a location surrounding or adjacent to the biasing element 10 and then down through the connecting ports 9 and 13 which are located on projections from the end cap away from the release latch 7, towards the extruded member 1. The reinforcing pin 14 may be hollow and the biasing element 10 may be located within the reinforcing pin 14 with an element within the reinforcing pin to cause the biasing element 10 to exert force on the release latch 7, similar to a roll pin 11. Alternatively, the reinforcing pin 14 may have a slit to allow a roll pin 11 to limit the movement of the biasing element 10 without hampering the movement of the reinforcing pin 14. Accordingly, either the roll pin 11 or in the alternative u-pin 14 may be used.

The portion of the reinforcing pin 14 that surrounds or is adjacent to the biasing element may terminate on the top of the portion of the release latch 7 that surrounds the biasing element 10. The reinforcing pin 14 terminates in a hole in a trap door that ends half way through the trap door. This configuration would cause the reinforcing pin 14 to rise as the release latch 7 is lifted and allow the reinforcing pin to drop as the release latch 7 falls. The portion of the reinforcing pin 14 that extends through the connecting ports 9 and 13 helps to maintain a connection to the extruded member 1. This portion of the reinforcing pin 14 may be of a length that prevents the pin from impeding the movement of rollers in or out of the slot that the articulating element, or trap door, is adjacent to. The reinforcing pin 14 may prevent separation of an end cap from an extruded member when a drawer with a heavy load is connected to a cabinet, and the drawer is fully extended, e.g. pulled out completely. As such, the u-pin may be used to reinforce the structure of the plastic end cap during 45 degree tip testing under load.

In use, one may need to obtain an extruded member and attach end cap members to each end. Ideally, each end cap serves to provide a stop or end to a first slot on one side of the extruded member while providing a trap-door entrance to a second slot on the reverse side of the extruded member. In some implementations, each side of the extruded member may have a slot for receiving one or more rollers and relative translation of the rollers along the extruded member may be stopped only by the end cap members attached to the ends of the extruded members.

A user, such as a professional assembler or a consumer, may construct ready to assemble furniture using the drawer slides disclosed herein. For example, the user may insert latch housings 4A-B into a drawer and insert latch housings 4C-D into a drawer housing (or cabinet skeleton) and attach the remaining portion of the roller assembly, that is to say rollers 5 and track pins 6, to the latch housings 4A-D. The locations of the latch housings may allow for full translation of the drawer outwards. The extruded member 1 with end cap members 2, 3 may be pushed such that the entry rail is inserted into rollers 5 located on the cabinet skeleton. When the extruded member 1 is pushed onto the rollers 5, the trap door 12 rises and the rollers 5 slide into the slot. After the last roller 5 has entered the slot, the trap door 12 moves into a closed position because of force from the biasing element 10, and the flat side of the trap door 12 maintains the rollers 5 in the slot. The rollers 5 that are attached to the drawer may roll onto a slot on the extruded member 1 in a similar fashion. To remove the drawer from the cabinet skeleton, a user may push on the release latch 7 leading to the slot that maintains the rollers 5 attached to the drawer. This action raises the articulating element, or trap door, 12, and the rollers 5 are free to move past the extruded member 1, releasing the drawer from the drawer slide.

In some implementations, the configuration of the extruded member in conjunction with the end cap members may offer desirable features for a furniture assembler or user of the finished piece of furniture, such as less complex assembly. Moreover, the configuration of the extruded member in conjunction with the end cap members may offer, in some implementations, advantages to the user, such as improved motion and safety. An additional advantage of some configurations is easy installation of a drawer into and removal of a drawer from a drawer housing or cabinet due to features such as the release latch on the end caps.

In general, the extruded member may be symmetric about its longitudinal axis, symmetric about its vertical axis, or symmetric about both axes. Similarly, the drawer slide may be symmetric about its longitudinal axis, symmetric about its vertical axis, symmetric about both axes, or symmetric about a central point. Such symmetry may provide advantages, not only to a user or furniture assembler, but also to a manufacturer, distributor, and the like. Cabinets and the like that utilize drawer slides as described herein, those that are symmetrical and are not limited to use on one side (e.g. the left hand side or right hand side of a drawer only) may reduce the types of equipment needed to manufacture parts, may reduce the number of parts a retailer would need to carry, may allow for simplified assembly instructions, and the like. Implementations of the drawer slide assemblies described herein are symmetrical and possess no handedness because of symmetry in the extruded member and the interchangeable nature of the end caps.

The drawer slide described herein may not allow disengagement of the drawer from the cabinet skeleton without intentional action of a user on the release latch of an end cap member. This reduces the likelihood that one would accidently pull a drawer completely out of a cabinet or other piece of furniture unintentionally. As mentioned hereinabove, the slots and the rollers may have complimentary shapes. In some embodiments, the rollers may appear to have v-shaped edges in cross section and the slots may have v-shaped grooves. Such a configuration may reduce vibration and create a smoother drawer withdrawal as compared to a drawer with a conventional drawer slide. Moreover, by using only a single rail element per side of the drawer (i.e., between a drawer and the corresponding cabinet/skeleton/shell), the extruded member with end cap members may, in some implementations, provide relatively smooth motion when opening or closing a drawer. The relatively smooth motion may be regardless of the load, or weight, within the drawer or placed on the drawer during opening or closing.

In some implementations, reduced complexity in assembling the drawer slide may be provided based on the connection (e.g., the roller assembly including latch housing) of the drawer slide to the drawer and cabinet skeleton and/or the interchangeability of the drawer slides (e.g., the drawer slide 100 can be used on the left and the right side of the drawer without modification). The connection of the drawer slide to the drawer and cabinet may not require screws or nails. The drawer slide described herein may, in some exemplary implementations, be further characterized by a side to side motion, or racking, that is about 6 mm or less, when the drawer is fully extended. In some implementations, the racking may be about 10 mm, about 9 mm, about 8 mm, or about 7 mm or less.

The drawer slide assembly may have an extruded member of any length. The drawer slide assembly may have an overall length ranging from less than about 12 inches (30.5 cm) to greater than about 24 inches (61 cm). The overall length of the drawer slide assembly may be less than about 12 inches (30.5 cm), about 12 inches (30.5 cm), about 14 inches (35.5 cm), about 16 inches (40.6 cm), about 18 inches (45.7 cm), about 20 inches (50.8 cm), about 22 inches (56 cm), about 24 inches (61 cm), or greater than about 24 inches (61 cm). The drawer slide assembly can yield a varying degree of extension of a drawer from a drawer housing or cabinet skeleton. The degree of extension may be controlled by the location of the rollers, the degree of extension may include about ¾ extension, full extension, about 3 inches (7.62 cm) over full extension, and the like.

Though the drawer slides discussed herein have largely been described in implementations where there is one drawer slide on a right and one drawer slide on a left side a drawer, it is possible that one drawer slide per drawer may be used, or more than two drawer slides per drawer may be used. Alternatively, or additionally, the drawer slides may be attached to the bottom of a drawer and to a corresponding, suitable location in a drawer housing or cabinet skeleton.

Although only a few implementations have been described in detail above, other modifications are possible. Nevertheless, it will be understood that various modifications may be made without departing from the spirit and scope of the claims below. For example, the components shown in the figures may include other components with similar functionality. Accordingly, other implementations are within the scope of the following claims.

What is claimed is:

1. A drawer slide assembly comprising:

an elongate member comprising:

a first slot extending through an upper region of a first face of the elongate member between a first end region of the elongate member and an opposite, second end region of the elongate member, the first end region having an exposed end into the first slot and at least a first opening through an upper surface of the upper region of the elongate member into the first slot, and a second slot extending through a lower region of a second face of the elongate member between the first end region and the second end region of the elongate member, wherein the second face is opposite the first face, and wherein the second end region has an exposed end into the second slot and at least a second opening through a lower surface of the lower region of the elongate member into the second slot;

a first end cap coupled to the first end region of the elongate member and covering at least the exposed end into the first slot, wherein the first end cap has a first projection that extends at least in part through the first opening and a first articulating element and a first biasing element that articulates the first articulating element linearly in a direction substantially orthogonal to the upper surface of the elongate member into a closed position; and a second end cap coupled to the second end region of the elongate member and covering at least the exposed end into the second slot, wherein the second end cap has a second projection that extends at least in part through the second opening and a second articulating element and a second biasing element that articulates the second articulating element into a closed position.

2. The drawer slide assembly of claim 1, wherein at least one of the first and second projections is an attachment mechanism configured to attach at least one of the first and second end caps to the elongate member.

3. The drawer slide assembly of claim 2, wherein the first projection is a first reinforcement pin that extends through the first slot and at least a portion of the second slot and wherein the second projection is a second reinforcement pin extends through the second slot and at least a portion of the first slot.

4. The drawer slide assembly of claim 3, wherein at least one of the first and second reinforcement pins is U-shaped.

5. The drawer slide assembly of claim 1, wherein at least one of the first and second projections is formed at least in part of hardened metal.

6. The drawer slide assembly of claim 1, wherein the first and second articulating elements are each configured to articulate in a direction orthogonal to a longitudinal axis of the elongate member between the closed position and an open position.

7. The drawer slide assembly of claim 6, wherein the closed position of the first articulating element comprises the first articulating element articulated toward a longitudinal axis of the first slot, and wherein the open position of the first articulating element comprises the first articulating element articulated away from the longitudinal axis of the first slot.

8. The drawer slide assembly of claim 6, wherein the closed position of the second articulating element comprises the second articulating element articulated toward a longitudinal axis of the second slot, and wherein the open position of the second articulating element comprises the second articulating element articulated away from the longitudinal axis of the second slot.

9. The drawer slide assembly of claim 6, further comprising at least a first roller and a second roller.

10. The drawer slide assembly of claim 9, wherein the first roller is configured to insert and move through the first slot and wherein the second roller is configured to insert and move through the second slot.

11. The drawer slide assembly of claim 10, wherein the first articulation element in the closed position prevents the first roller moving through the first slot from exiting the first slot and wherein the second articulation element in the closed position prevents the second roller moving through the second slot from exiting the second slot.

12. The drawer slide assembly of claim 9, wherein each of the articulating elements further comprises a flat surface facing the slot and an inclined surface facing away from the slot.

13. The drawer slide assembly of claim 12, wherein application of pressure by the rollers on the inclined surfaces causes articulation of the articulating elements into the open position and allows entry of the rollers into the slots.

14. The drawer slide assembly of claim 6, wherein each of the articulating elements further comprises a manual release latch that is configured to articulate the articulating elements into the open position.

15. The drawer slide assembly of claim 10, wherein the first roller has a first latch configured to couple the first roller to a cabinet or drawer and wherein the second roller has a second latch configured to couple the second roller to a cabinet or drawer.

16. The drawer slide assembly of claim 15, wherein the drawer slide assembly is affixed to the cabinet or drawer only by the first and second rollers inserted and moving through the first and second slots.

17. The drawer slide assembly of claim 1, wherein the drawer slide assembly possesses no handedness allowing the assembly to be used on either a right side or a left side of a drawer.

18. The drawer slide assembly of claim 17, wherein the elongate member is symmetrical about its longitudinal axis and about its central axis, and wherein the first and second end caps are interchangeable.

19. A drawer slide assembly comprising:

an elongate member comprising:

a first slot extending through an upper region of a first face of the elongate member between a first end region of the elongate member and an opposite, second end region of the elongate member, wherein the first end region of the elongate member has at least a first opening into the first slot, and a second slot extending through a lower region of a second face of the elongate member between the first end region and the second end region of the elongate member, wherein the second face is opposite the first face, wherein the second end region of the elongate member has at least a second opening into the second slot;

a first end cap coupled to the first end region of the elongate member, wherein the first end cap comprises a first projection that extends at least in part through the first opening and a first articulating element;

a second end cap coupled to the second end region of the elongate member, wherein the second end cap has a second projection that extends at least in part through the second opening and a second articulating element; and at least a first roller and a second roller, wherein the first and second articulating elements are each configured to articulate in a direction orthogonal to a longitudinal axis of the elongate member between a closed position and an open position, and wherein the first and second articulating elements each comprise a flat surface facing the slot and an inclined surface facing away from the slot, wherein application of pressure by the first and second rollers on the inclined surfaces causes articulation of the articulating elements into the open position and allows entry of the rollers into the slots.

* * * * *